US005205366A

United States Patent [19]

Klemm

[11] Patent Number: 5,205,366

[45] Date of Patent: Apr. 27, 1993

[54] SUPERPOSED DRILLING DEVICE

[75] Inventor: Guenther W. Klemm, Olpe, Fed. Rep. of Germany

[73] Assignee: Ing. Guenter Klemm Bohrtechnik GmbH, Fed. Rep. of Germany

[21] Appl. No.: 878,124

[22] Filed: May 4, 1992

[30] Foreign Application Priority Data

May 3, 1991 [DE] Fed. Rep. of Germany ..... 4114457

[51] Int. Cl.[5] ..... E21B 17/07

[52] U.S. Cl. ..... 175/390; 175/415

[58] Field of Search ..... 175/385, 389-392, 175/414, 415

[56] References Cited

U.S. PATENT DOCUMENTS 3,227,230 1/1966 Lagerstrom ..... 175/389
3,370,658 2/1968 Jansson ..... 175/390
3,613,807 10/1971 Gallis ..... 175/415 X
5,038,874 8/1991 Larsson et al. ..... 175/415 X

*Primary Examiner*—Thuy M. Bui
*Attorney, Agent, or Firm*—Diller, Ramik & Wight

[57] ABSTRACT

The device comprises a solid drill bit (28) and an annular drill bit (40). Axial impacts are exerted on the solid drill bit (28) which are transmitted onto the annular drill bit (40) through impact transmission surfaces. The annular drill bit (40) is freely axially displaceable within limits. It has rearwardly projecting tongues (43) that engage windows (15) of an outer pipe end piece (12). Thus, the movability of the annular drill bit (40) is ensured without any keyings or the like being necessary, which entail the risk of a clogging with bore material. All movable parts are included in the scavenging so that jamming is avoided.

7 Claims, 3 Drawing Sheets

SUPERPOSED DRILLING DEVICE

BACKGROUND OF THE INVENTION

The present invention refers to a superposed drilling device wherein impacts are transmitted onto a solid drill bit, and which is provided with an annular drill bit that is impact-coupled to the solid drill bit so that the impact is transmitted from the solid drill bit onto the annular drill bit.

In superposed drilling, used in ground boring and rock drilling, two coaxial drill strings are employed. The inner string is provided with a solid drill bit and the outer string is provided with an annular drill bit surrounding the solid, drill bit. Both strings are advanced rotatingly, the inner string possibly being subjected to impacts. Such impacts may either be generated by an external hammer provided outside the borehole and at the rear end of the inner string, or a deep-hole hammer arranged near the solid drill bit along the longitudinal axis of the inner string. Impacts dealt on the outer string would be absorbed for a large part by the surrounding earth so that they would reach the annular drill bit with a greatly reduced impact energy.

U.S. Pat. No. 3,682,260 describes a superposed drilling wherein a deep-hole hammer strikes the solid drill bit. The solid drill bit and the annular drill bit have cooperating impact transmission surfaces by which the impacts are transmitted from the solid drill bit onto the annular drill bit. In this manner, both drill bits are operated by rotation and impacts, although the annular drill bit has no impact drive means of its own. It is a drawback, however, that upon each blow, the annular drill bit is pulled forward on the outer string so that the outer string is subjected to considerable impact tensile stress. Thus, the threads of the outer pipe string may be damaged or break.

German Patent 21 55 540 describes an improved superposed drilling device wherein the annular drill bit is guided by means of keybeds so as to be longitudinally displaceable at an end piece of the outer string. Also in this case, the impacts are transmitted from the solid drill bit onto the annular drill bit by impact transmitting surfaces so that both drill bits are driven by impacts. The engaging keybeds, provided at the annular drill bit and at the end piece of the outer pipe, which allow for the axial displacement of the annular drill bit upon each impact without stressing the outer pipe string, form bottlenecks in which bore material may gather. In practice, the keybeds are clogged with the loosened bore material so that a displaceability of the annular drill bit is no longer ensured. It may then occur that the impacts are no longer transmitted onto the annular drill bit or that the impacts transmitted onto the annular drill bit do generate considerable tensile stress in the outer pipe string and cause strain thereon. The keybeds or the splines may also jam, thereby impairing the displaceability of the annular drill bit. Drilling devices using an impact transmission from the solid drill bit onto the annular drill bit were not successful in practice due to the above drawbacks.

SUMMARY OF THE INVENTION

It is the object of the invention to provide a superposed drilling device wherein a transmission of impacts from the solid drill bit onto the annular drill bit is performed, and which is not susceptible to malfunctions and jamming caused by bore material.

According to the present invention, the object is solved with the features of claim 1.

In the device of the present invention, the annular drill bit is displaceably mounted at the outer pipe end piece by virtue of the annular drill bit having rearwardly projecting axial tongues engaging corresponding windows in the outer pipe end piece. These windows are apertures in the wall of the outer pipe end piece and are more or less closed by the tongues of the annular drill bit depending on the respective axial displacement of the annular drill bit. The annular drill bit has no grooves or indentations on its circumference. Consequently, no gaps can occur in which the bore material could be compressed. When the annular drill bit is in the front end position, the windows are opened and scavenged by the scavenging agent supplied thereto. There are no dead corners that cannot be scavenged. The tongues of the annular drill bit engage the windows of the outer pipe end piece in the manner of a claw clutch, thereby ensuring a rotational engagement.

The number of the tongues and windows may be greatly reduced so that the intermediate wall portions separating the tongues and windows each have a sufficient circumferential extension and sufficient strength. At least two tongues are provided, yet, preferably, four tongues are employed. The tongues have approximately the same width as the spaces between the tongues so that a uniform load distribution is obtained.

Suitably, the windows of the outer pipe end piece are open to the front end, where they are delimited by an annular band surrounding the outer pipe end piece, which annular band simultaneously serves to prevent a spreading of the tabs defining the windows. The annular band further serves to limit the forward movement of the annular drill bit since it serves as a stop for a head projecting outward from each tongue.

To prevent the tongues of the annular drill bit from bending inward, they are radially supported by the shaft of the solid drill bit or a pipe piece enclosing this shaft.

The ends of the tongues are suitably pointed to form stripping edges so that remainders of bore material that could impair the displaceability of the annular drill bit, are stripped off to the outside and cannot form dangerous gatherings.

BRIEF DESCRIPTION OF THE DRAWINGS

The following is a detailed description of embodiments of the present invention taken in conjunction with the accompanying drawings in which.

DESCRIPTION OF THE PREFERRED EMBODIMENT

The drawings illustrate the end of an outer pipe string 10 and an inner pipe string 11 at the borehole side. The rear ends of both drill strings 10 and 11 may be driven by a double-headed drilling machine arranged outside the borehole and having a sledge displaceable on a carriage. Provided on this sledge are two drill units that are longitudinally displaceable relative to each other, the front drill unit rotating the outer pipe string 10 and the rear drill unit driving the inner pipe unit 11. The rotations may be effected with the same or different numbers of rotations, as well as in the same sense of rotation and in opposite senses of rotation, optionally. The drill means may also have a single rotary or rotary percussion drive acting upon the outer pipe and rotating the outer pipe.

Figure 1:
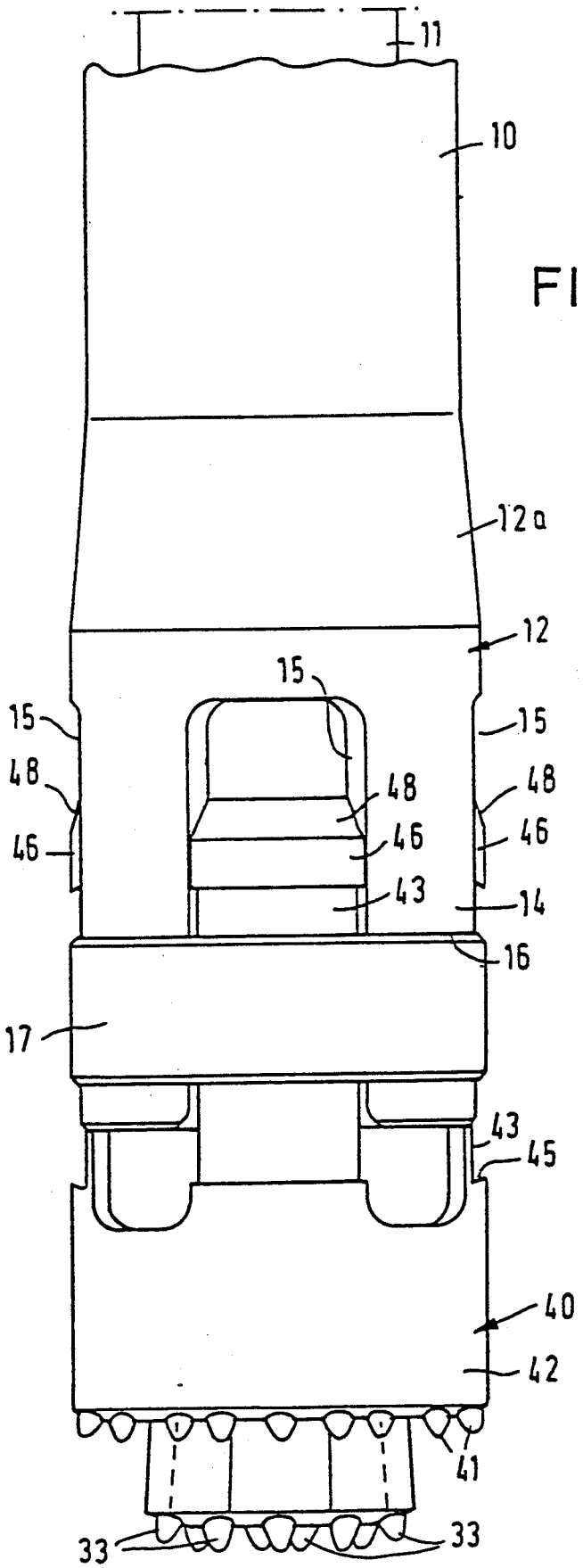
FIG. 1 is a side elevational view of the drilling device with a deep-hole hammer.
Figure 2:
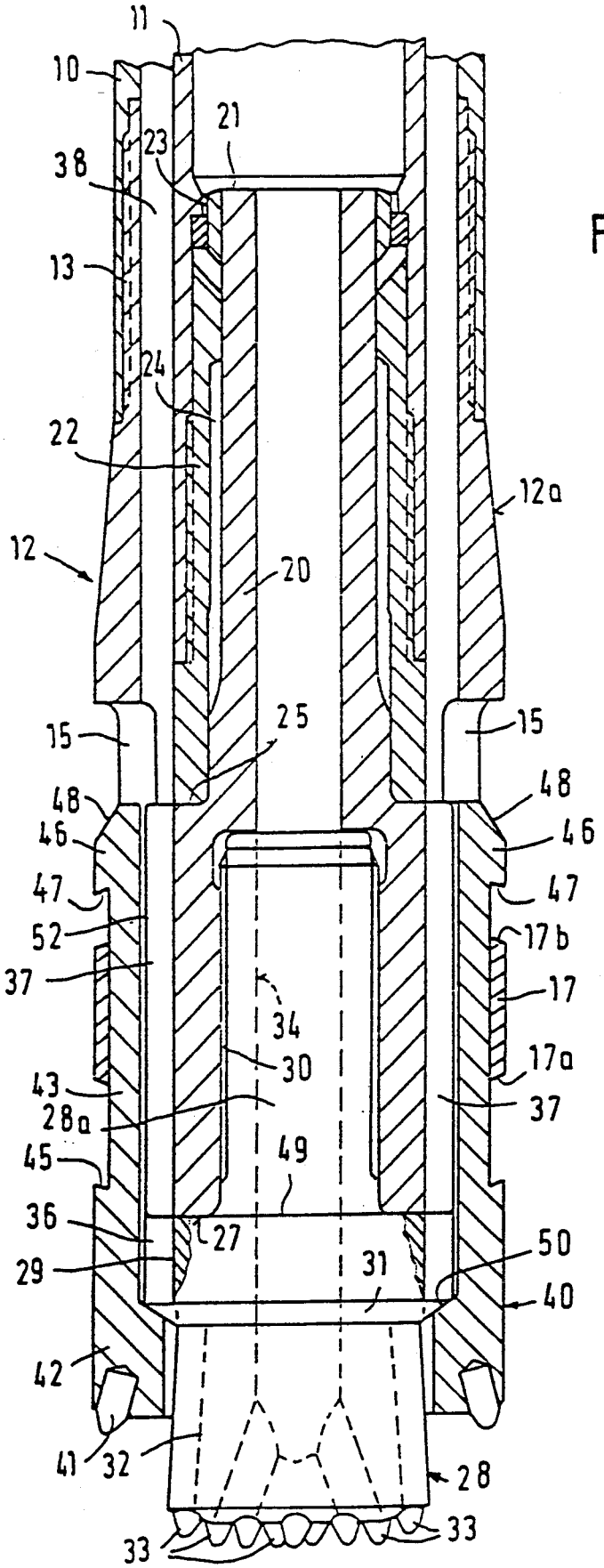
FIG. 2 is a longitudinal section of the drilling device of FIG. 1.

In the embodiment of FIGS. 1 and 2, a generally tubular outer pipe end piece 12 is screwed to the front end of the outer pipe string 10 through a threading 13. This outer pipe end piece 12 has a conical portion 12*a* in which its wall thickness increases outward and to the front, namely to 1.5 times the wall thickness of the outer pipe string 10. The inner width, in contrast thereto, is equal over the entire length of the end piece 12 to the inner width of the outer pipe string 10.

At its front end, in the region of its greater wall thickness, the outer pipe end piece 12 is provided with tabs 14 projecting axially parallel and respectively defining windows 15. These windows 15 are rectangular apertures in the wall of the outer pipe end piece 12, i.e. they are portions in which the wall is completely removed. The apertures forming the windows 15 terminate freely at the front (i.e. borehole-side) end of the outer pipe end piece 12, since also the rectangular tabs 14 project freely and are not integrally interconnected at their ends.

In the present embodiment, four tabs 14 are evenly distributed along the circumference of the outer pipe end piece, the tabs laterally defining four windows 15. The width of each tab 14 is substantially equal to the width of a window 15.

Each tab 14 has an outer circumferential groove 16 near its front end. Seated in these circumferential grooves 16 is an annular band 17 encircling the circumference of the outer pipe end piece 12 in the area of the tabs 14 and defining the windows 15 to the front. The front edge 17*a* and the rear edge 17*b* of the annular band 17 are chamfered to form stripping edges.

The front end of the inner pipe string 11 is provided with a pipe piece 20, onto the rear end 21 of which a deep-hole hammer (not illustrated), arranged in the inner pipe string 11, strikes. By means of a thread 22 screwed into the outer pipe string 10, the pipe piece 20 is fixed so as to be axially displaceable within limits such that the pipe piece 20 can make limited axial movements relative to the inner pipe string 11. Keyings 23 and 24 at the pipe piece 20 and the surrounding screwed member 22 cause a rotary connection of the pipe piece 20 with the outer pipe string 11. The front shoulder of the keying 23 secures the pipe piece 20 against being pulled out from the screwed member 22 to the front. The pipe piece 20 has a rear annular shoulder 25 abutting against the front end of the screwed member 22, thereby defining the rearward movement of the pipe piece 20.

The pipe piece 20 extends forward beyond the front ends of the tabs 14 of the outer pipe end piece 12. The front end face 27 of the pipe piece 20 forms the rear end abutment of an annular collar 29 of the solid drill bit 28. The solid drill bit 28 has a drill bit shaft 28*a* extending into the pipe piece 20 and being connected to the pipe piece 20 by keyings 30 so as to be rotatable therewith, yet also axially displaceable. The conical front end face of the annular collar 29 forms a impact transmission surface 31. The drill bit head 32 of the solid drill bit 28 projects forward therefrom. Hard metal pins 33 for working on the bottom of the borehole are arranged on the end face of the drill bit head 32.

A scavenging channel 34 extending over the entire length of the solid drill bit 28, the scavenging channel being communicated with the inside of the inner drill string 11 via the inside of the pipe piece 20. Via this scavenging channel 34 having outlets in the drill bit head 32, a scavenging medium, e.g. air or water, is supplied to the bottom of the borehole. Wide backflush grooves 36 and 37 are provided in the flange 29 and at the circumference of the pipe piece 20, through which grooves the scavenging medium and the loosened bore material are flushed backward. These backflush grooves are in communication with the annular channel 38 between the outer pipe string and the inner pipe string. Outside the borehole, the scavenged material is discharged from this annular channel 38.

The front portion of the pipe piece 20, as well as the solid drill bit 28 are surrounded by an annular drill bit 40 that is studded with hard metal pins 41 at its front end. The annular drill bit has an annular drill bit head 42 and tongues 43 projecting rearward therefrom. Each of the tongues extends into one of the windows 15 of the outer pipe end piece 12 wherein they are axially displaceable. The spaces between two tongues 43 are respectively filled by one of the tabs 14 of the outer pipe end piece 12. The outer surfaces of the tongues 43 are on a (imaginary) cylinder surface having a diameter smaller than the outer diameter of the head piece 42. The step at the rear end of the head piece 42 is formed as an undercut 45.

At the rear end of each tongue, there is an outwardly projecting head 46 delimiting the forward movement of the annular drill bit 40 by abutting against the annular band 17 fixed at the outer pipe end piece 12. The front edge of the head 46 is formed as an undercut 47 which the stripping edge 17*b* of the annular band 17 can engage. The rear edge 48 of the head 46 is chamfered for forming a stripping edge.

Impacts exerted onto the impact surface 21 of the pipe piece 20 are transmitted via the impact transmission surface 31 onto the rear end surface 49 of the flange 29 of the solid drill bit 28 so that the drill bit head 32 strikes the bottom of the borehole.

The impact transmission surface 31 of the solid drill bit 28 cooperates with an impact transmission surface 50 within the annular drill bit 40 so that the impacts on the solid drill bit 28 are transmitted via the impact transmission surfaces 31 and 50 also onto the annular drill bit 40. The annular drill bit 40 may slide freely in the longitudinal direction, since its heads 46 can slide in the longitudinal direction within the windows 15. The drawings each illustrate a central position of the annular drill bit, the heads having free spaces in the windows 15, both in the frontward and the rearward directions. Impacts transmitted onto the annular drill bit 40 are not transmitted onto the outer pipe end piece 12 so that the outer pipe string 10 is not stressed by impacts.

Corresponding to the axial position of the annular drill bit 40 relative to the outer pipe end piece 12, the rear parts of te windows 15 are left open, while the front portions of these windows are closed by the tongues 43. Through the open portions of the windows 15, scavenging medium that has gotten into the area outside the drill bits can be lead into the backflush channel 38 and can be guided back between the outer and the inner pipe strings. The tongues 43 engaging the windows 15 further cause a rotary coupling of the annular drill bit 40 and the outer pipe end piece 12 fixedly mounted at the outer pipe string 10.

The front portion 52 of the pipe piece 20 between the annular shoulder 25 and the front end surface 27 has an outer diameter that is as large as to support the tongues 43 from inside and to prevent the tongues 43 from bending inward. Thus, it is ensured that the tongues 43 cannot slip from under the annular band 17 due to an inwardly directed bending.

In the described embodiment of FIGS. 1 and 2, a deep-hole hammer is provided within the inner pipe 11, which strikes on the rear end 21 of the pipe piece 20 and the impacts of which are transmitted from the pipe piece 20 onto the drill bit shaft 28*a*. It is also possible when using a deep-hole hammer, to have the deep-hole hammer strike immediately on the drill bit shaft 28*a*.

Figure 3:
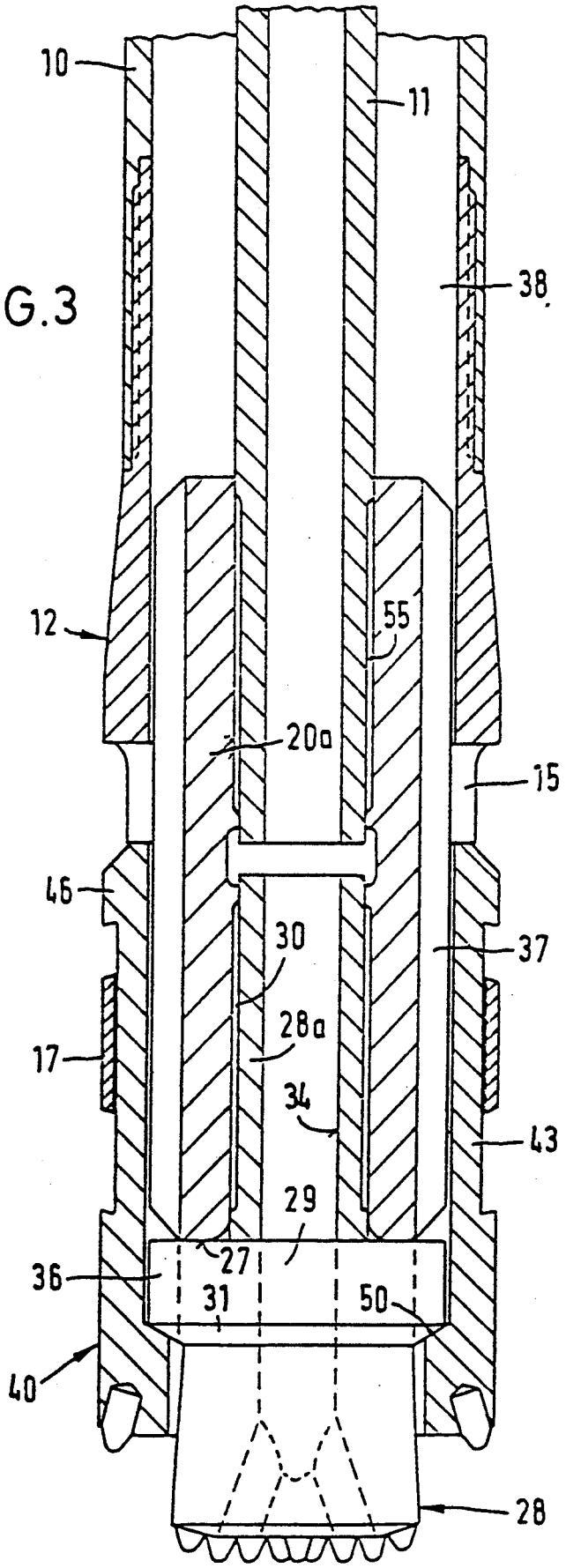
FIG. 3 is a longitudinal section of a drilling device wherein the impacts are generated by an external hammer.

FIG. 3 illustrates an embodiment in which the impact energy is provided by an external hammer arranged outside the borehole, the impacts being tramitted onto the solid drill bit 28 over the entire length of the inner pipe string 11.

Screwed to an outer thread 55 at the front end of the inner pipe string 11 is a pipe piece 20*a* that protrudes forward beyond the inner pipe string 11 and which, at its projecting portion, is in engagement with the drill bit shaft 28*a* via engaging keyings so that the solid drill bit 28 is connected for rotation with the pipe piece 20*a*, yet is still axially displaceable. The front end face 27 of the pipe piece 20*a* abuts against the annular collar 29 of the solid drill bit 28. The impacts are transmitted from the impact transmission surface 31 of the annular collar 29 onto the inner impact transmission surface 50 of the annular drill bit 40.

Moreover, the embodiment of FIG. 3 is similar to that of FIGS. 1 and 2. Externally, the device of FIG. 3 looks exactly like the first embodiment so that reference is made to FIG. 1 in that respect.

According to FIG. 3, the pipe piece 20*a* connected to the inner pipe string 11 forms a guiding for the solid drill bit 28 and a radial support for the tongues 43 of the annular drill bit 40. Thus, the pipe piece 20*a* bridges an annular space between the inner pipe string 11 or the drill bit shaft 28*a* and the outer pipe end piece 12, yet it includes longitudinally extending backflush grooves 37 that are aligned with backflush grooves 36 in the annular collar 29. Further, the annular drill bit 28 has a scavenging channel 34 that is continuous in the longitudinal direction and is in communication with the inside of the inner pipe string 11.

I claim:

1. A superposed drilling device comprising a solid drill bit (28) onto which impacts are exerted or transmitted, and an annular drill bit (40) enclosing said solid drill bit (28), which is axially movable relative to said solid drill bit (28), said solid drill bit (28) and said annular drill bit (40) being coupled to each other by impact transmission surfaces (31, 50) that abut against each other and transmit the impacts onto said annular drill bit (40), characterized in that said annular drill bit (40) has axially projecting tongues (43) that engage windows (15) of an outer pipe end piece (12) in a longitudinally displaceable manner, said outer pipe end piece guiding said annular drill bit.

2. The device of claim 1, wherein said windows (15) are delimited at their front ends by an annular band (17) surrounding said outer pipe end piece (12), and wherein the rear ends of said tongues (43) have outwardly projecting heads (46) that delimit the forward movement of said annular drill bit (40) within said outer pipe end piece (12).

3. The device of claim 2, wherein the rear edge (17*b*) of said annular band (17) is chamfered to form a stripping edge.

4. The device of claim 3, wherein the front ends of said heads (46) have undercuts (47) into which said stripping edge of said annular band (17) immerses.

5. The device of claim 2, wherein the front edge (17*a*) of said annular band (17) is chamfered to form a stripping edge.

6. The device of claim 1, wherein said solid drill bit (28) or a pipe piece (20) guiding the same supports said tongues (43) of said annular drill bit (40) from the inside.

7. The device of claim 1, wherein the outsides of the rear ends of said tongues (43) are chamfered to form a stripping edge (48).

* * * * *